US005984290A

United States Patent [19]

Durfee, Jr.

[11] Patent Number: 5,984,290

[45] **Date of Patent: *Nov. 16, 1999**

[54] ENCLOSED TWO STATION MACHINING VISE WITH REMOVABLE AND OFF-SETTABLE JAWS

[75] Inventor: David L. Durfee, Jr., Meadville, Pa.

[73] Assignee: Te-Co., Englewood, Ohio

[ * ] Notice: This patent is subject to a terminal disclaimer.

[21] Appl. No.: 08/950,485

[22] Filed: Oct. 15, 1997

Related U.S. Application Data

[63] Continuation of application No. 08/810,457, Mar. 4, 1997, abandoned, which is a continuation of application No. 08/510,880, Aug. 3, 1995, abandoned.

[51] Int. Cl.[6] ..... B25B 1/10

[52] U.S. Cl. ..... 269/43; 269/136; 269/154; 269/244; 269/283; 269/284; 269/906

[58] Field of Search ..... 269/43, 88, 136, 269/138, 152, 153, 154, 204, 217, 235, 242, 244, 269, 279, 282, 283, 284, 25, 39, 906

[56] References Cited

U.S. PATENT DOCUMENTS

| | | | |
|---|---|---|---|
| 617,113 | 1/1899 | Marcille | 269/242 |
| 1,811,299 | 6/1931 | Brockhaus, Jr. | 269/242 |
| 2,274,428 | 2/1942 | Odin | 269/138 |
| 5,114,126 | 5/1992 | Yasue | 269/136 |
| 5,242,159 | 7/1993 | Bernstein | 269/43 |
| 5,442,844 | 8/1995 | Swann | 269/43 |
| 5,458,321 | 10/1995 | Durfee, Jr. | 269/43 |
| 5,505,437 | 4/1996 | Durfee, Jr. | 269/43 |
| 5,535,995 | 7/1996 | Swann et al. | 269/242 |

*Primary Examiner*—Robert C. Watson
*Attorney, Agent, or Firm*—Jacox, Meckstroth & Jenkins

[57] ABSTRACT

In a two station machining vise having a stationary, center jaw and movable opposing jaws, the interior of the vise body is totally enclosed to protect the working components from machining byproducts. The vise has a brake mechanism and an offset mechanism associated with one slide so that workpieces can be engaged and released sequentially. If the brake mechanism is not activated, the two movable jaws are moved simultaneously. With the brake mechanism engaged, one movable jaw is moved to position first and then the movable jaw having the brake and offset mechanisms connected therewith is subsequently moved into position. When the workpieces are to be released, the second movable jaw is first retracted the offset distance and then the first movable jaw must be completely retracted prior to any subsequent movement by the first movable jaw.

7 Claims, 9 Drawing Sheets

ENCLOSED TWO STATION MACHINING VISE WITH REMOVABLE AND OFF-SETTABLE JAWS

RELATED APPLICATIONS

This application is a continuation of application Ser. No. 08/810,457, filed Mar. 4, 1997, abandoned, which is a continuation of application Ser. No. 08/510,880, filed Aug. 3, 1995, abandoned.

BACKGROUND OF THE INVENTION

1. Field of the Invention

The invention relates to an enclosed vise having a stationary jaw and two movable jaws for use in the precision machining of work pieces.

2. Description of the Related Art

Two station machining vices are known in the art. Examples of such two station vises are disclosed in U.S. Pat. No. 4,966,350 to Chick, U.S. Pat. No. 4,529,183 to Krason et al., U.S. Pat. No. 4,934,674 to Bernstein, U.S. Pat. No. 5,022,636 to Swann, U.S. Pat. No. 5,098,073 to Lenz and U.S. Pat. No. 4,685,663 to Jorgensen.

Further, a number of U.S. patents, in particular U.S. Pat. Nos. 4,529,183; 4,098,500; 4,685,663 and 5,024,427 disclose various methods of mounting jaw blocks to the vise slides.

However, all of these known vises suffer the problem that they have at least an open channel accommodating the vise slides into which machine chips and machining fluid may be introduced. As a result, the operation of the vise is degraded due to the build up of these materials. Further, it is necessary to clean the vise in order to avoid any significant degradation in vise operation. Such a requirement results in down time for the vise thereby incurring maintenance expenses while losing production.

Further, vises of this type generally fixedly mount the stationary, center jaw by bolting the jaw to the shoulders, or rails, of the vise. As a result, replacement of the stationary, center jaw is relatively time consuming, again incurring labor costs while reducing production efficiency.

U.S. patent applications Ser. Nos. 08/113,048 and 08/229,806, having the inventor in common with this application, are also drawn to two station machining vises. They disclose offset mechanisms and latching means for attaching jaws to the movable slides. They also disclose a brake mechanism for restricting movement of one movable slide until the other movable slide has had its movement impeded. The disclosures of both applications are incorporated herein by reference thereto.

SUMMARY OF THE INVENTION

The invention relates to an enclosed two-station vise that can hold two workpieces to be machined against oppositely facing surfaces of a removable, stationary, center jaw mounted to a center of the vise body. The movable jaws move toward and away from opposite surfaces of the stationary, center jaw for clamping the workpieces therebetween.

A threaded screw is rotatably mounted in one movable slide jaw and threadably engages a bore of the second movable jaw slide. A spline rotator is rotatably mounted in one end of the vise and engages the threaded screw. A brake assembly and an offset assembly are mounted in the vise body and resiliently attached to the second slide to permit non-simultaneous engagement of workpieces at the two work stations. Covers are provided over the center channel of the vise and the ends of the vise are sealed to create a totally enclosed interior of the vise which contains the operating components.

It is an object of the invention to use the threaded screw, with the brake applied to the one jaw slide to position the movable jaws for symmetrical and non-symmetrical work pieces.

It is another object of the invention to permit the movable jaws to be positively mounted to the respective slides but to be quickly releasable and replaceable.

It is still another objective of the invention to permit the stationary, center jaw to be positively mounted to the rails of the vise but in a manner to be quickly releasable and replaceable.

It is a further object of the invention to totally enclose the working components within the interior of the vise to protect the components from machining byproducts, such as chips and fluids.

It is a still further object of the invention to provide a plurality of offset positions such that pre-release of one movable jaw prior to the release of the second movable jaw permits the handling of workpieces having varying configurations and degrees of tolerance with a minimum of rotation of the threaded screw to release the workpieces. When the jaws are used with parallels, see U.S. Pat. No. 5,037,075, the disclosure of which is incorporated herein by reference thereto, the ledge is maintained to support the workpiece when the workpiece is initially released.

BRIEF DESCRIPTION OF THE DRAWINGS

The invention will be described with reference to the drawings in which.

DETAILED DESCRIPTION OF THE PREFERRED EMBODIMENTS

Figure 1:
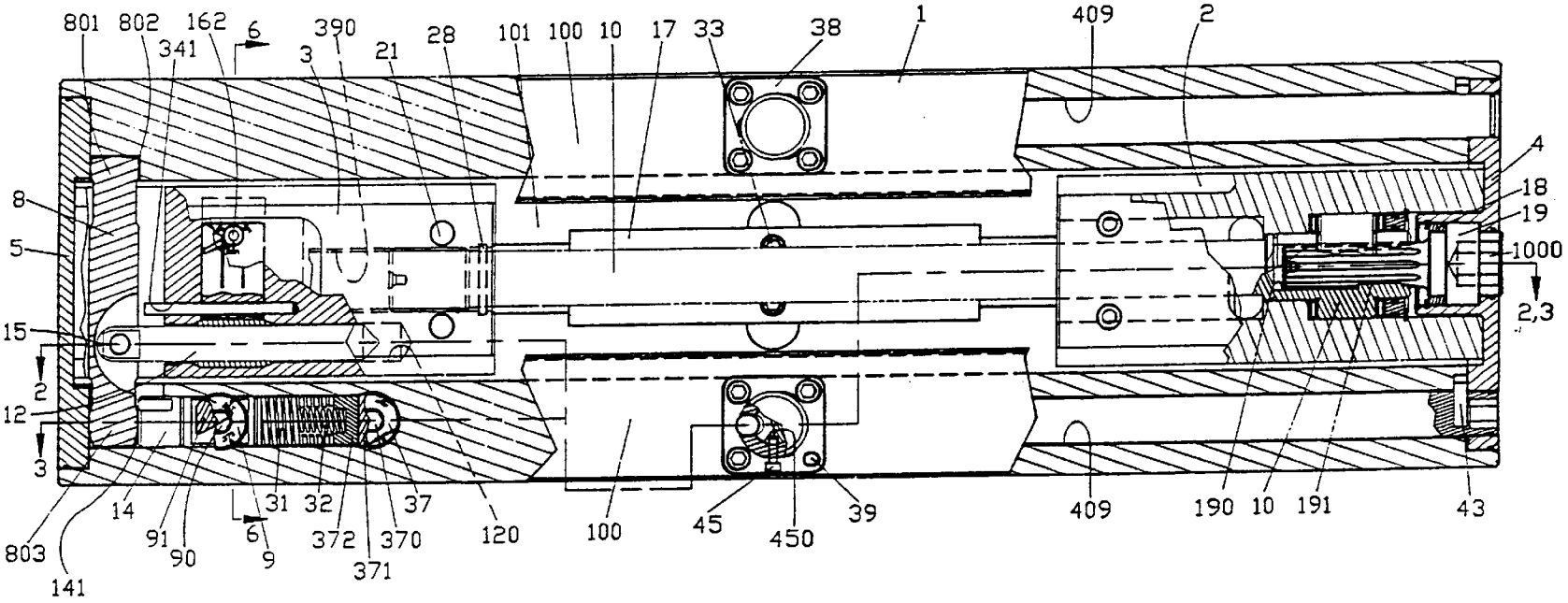
FIG. 1 is a top plan, partially cut away and partial cross-section view of the vise.
Figure 2:
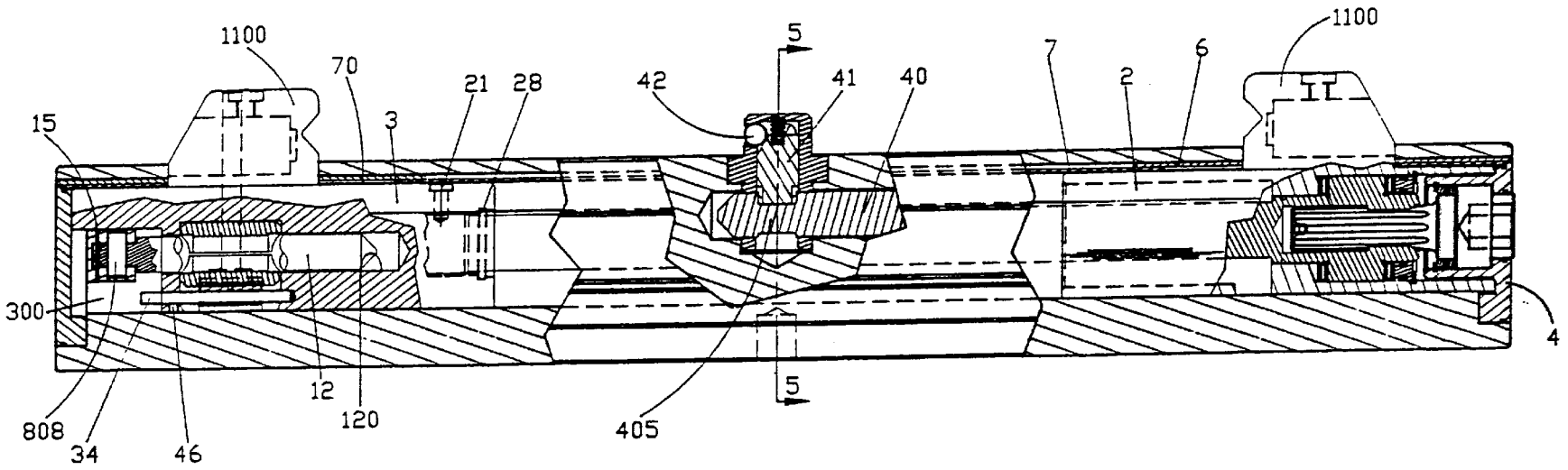
FIG. 2 is a partially cut away, partial cross-section view of the vise substantially along line 2—2 of FIG. 1.
Figure 3:
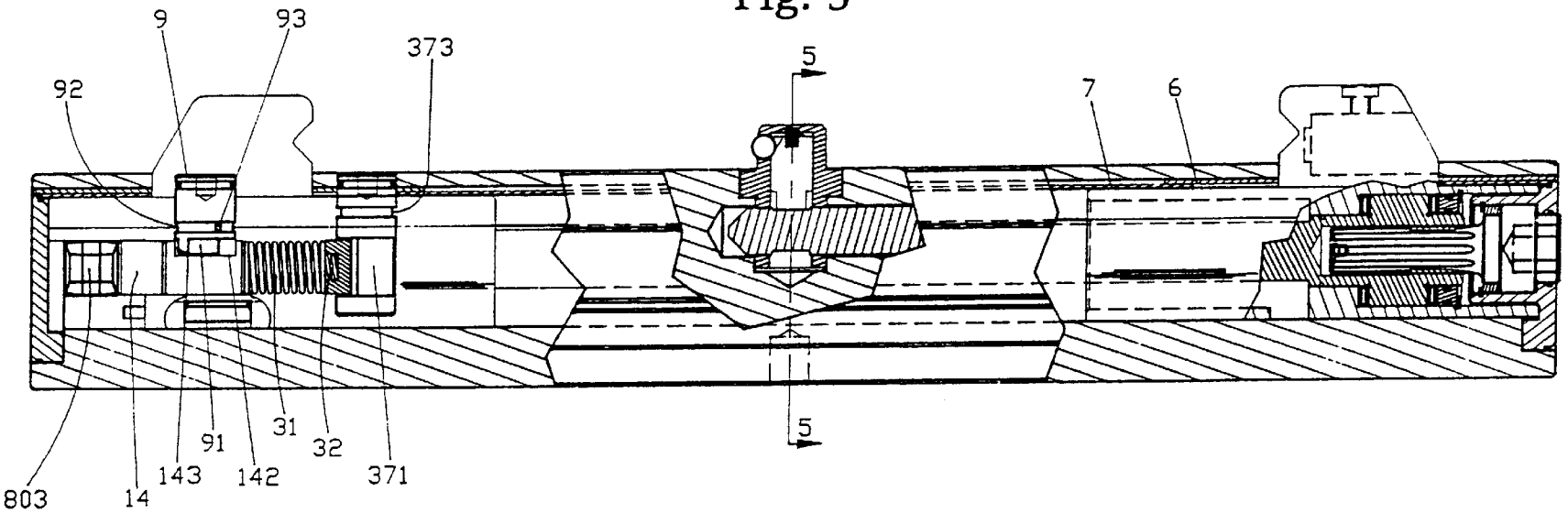
FIG. 3 is a partially cut away, partial cross-section side view of the vise substantially along line 3—3 of FIG. 1.
Figure 6:
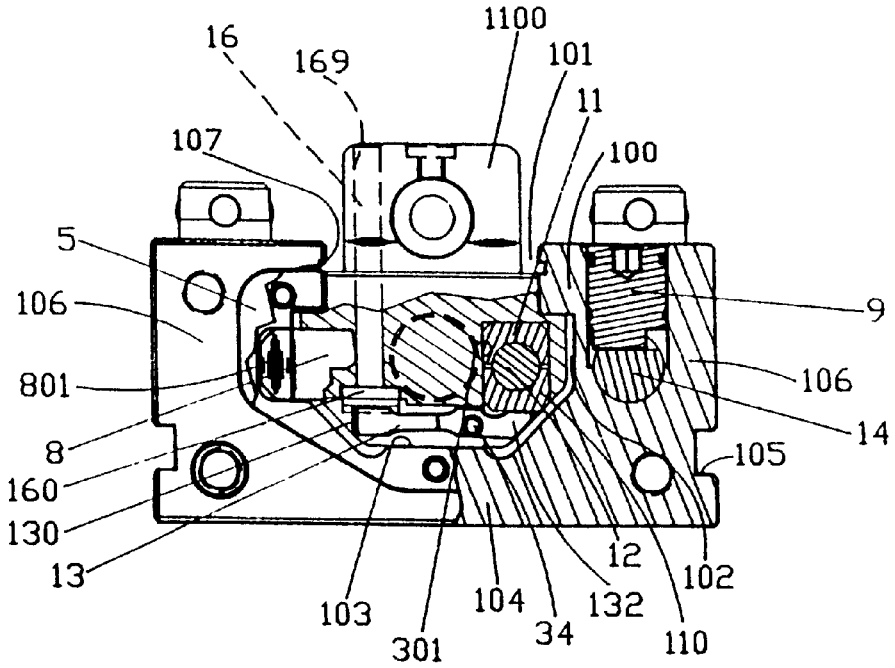
FIG. 6 is a partially cut away, partial cross-section of the rear end of the vise showing the brake assembly and offset dial, the cross-section portion being substantially along line 6—6 of FIG. 1.
Figure 7A:
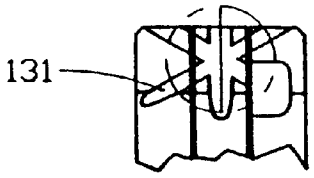
FIGS. 7A–7F show the respective positions of the brake spring assembly for providing a load to the brake.
Figure 7C:
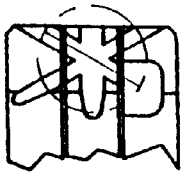
Figure 7E:
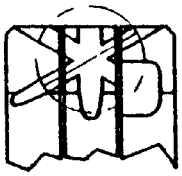
Figure 7B:
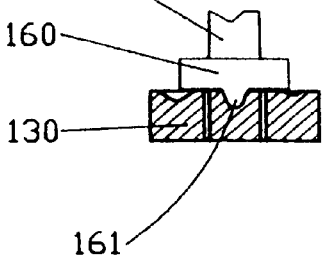
Figure 7D:
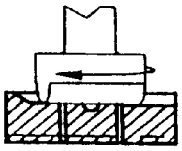
Figure 7F:
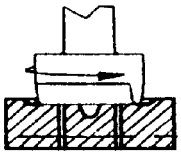

An enclosed two-station machine vise shown in top plan and side views in FIGS. 1–3 has a vise body 1 with an elongated central axis and a base 104 (FIG. 6). (For the purpose of this specification all directions are as if the base 104 of the vise 1 were resting on a flat surface.) As shown in FIG. 6, the outer surface for the base 104 has recesses 105 that may be used for mounting the body 1 to a work surface. Alternatively, projections, or ears, may extend from the body 1, or other methods for mounting the vise to various machines used for machining operations, may be used.

Sides 106 extend upwardly from the base 104 and have in-turned rails 100. The rails 100 define a channel 101 therebetween. A second, and larger, channel (FIG. 6) 102 is formed below the rails 100. A contact surface 103 extends longitudinally along the bottom of the large channel 102.

At a center position of the body 1 a locking center stud housing 38 (FIGS. 1–3, 5A and 5B) is mounted in each rail 100. The locking center stud housing 38 is seated in a bore extending through the rail 100 and into the side 106. A flange 381 extends from the locking center stud housing 38 and is seated within the rail 100 such that an upper surface of the flange is slightly recessed below the surface of the rail 100 to ensure smooth movement of the movable vise jaws supported on the rail 100. Mounting screws passing through the flange 381 and into the body 1 retain the locking center stud housing 38 in position.

A center line between locking center housings 38, on the opposing rails 100, is transverse to the longitudinal axis of the body 1. A hood 382 comprises an upper portion of the locking center stud housing 38 and extends above the surface of the rail 100. Three circular openings are provided in the hood 382 at equally spaced intervals. Located within the interior of the locking center stud housing 38 is a lock stud actuator piston 41 which has camming faces 410 opposite each of the openings in the hood 382. Between an upper surface of the lock stud actuator piston 41 and the enclosed hood 382 of the locking center stud housing 38 is a return spring 44 for normally biasing the lock stud actuator piston 41 in a downward direction. A ball 42 is provided between each paired camming face 410 and opening such that movement of the lock stud actuator piston 41 upward and downward permits the balls 42 to be urged to extend partially outside of or be withdrawn within the hood 382 respectively. The lock stud actuator piston 41 is actuated by a lock stud rotation cam shaft 40.

The lock stud rotation cam shaft 40 is seated in a bore 409 passing through the side 106, parallel to the longitudinal axis of the body 1. Located, in the lock stud rotation cam shaft 40, at the locking center stud housing 38 is a camming portion 405. The camming portion 405 has a substantially circular cross-section with a section removed. The removed section provides a retraction face 400. The camming portion 405 has an eccentric axis, that is, it has been formed so as to be eccentric to the lock stud rotation cam shaft 40 axis. The cylindrical surface, having the eccentric axis, forms a cam surface 401 for raising the lock stud actuator piston 41.

When the lock stud rotation cam shaft 40 is rotated such that the retraction face 400 abuts the base of the lock stud actuator piston 41, the lock stud actuator piston 41 is in a retracted position and the balls 42 are withdrawn within the locking center stud housing 38 thereby allowing removal of the stationary jaw 47. Conversely, when the lock stud rotation cam shaft 40 is rotated such that the cam surface 401 at the greatest distance from the eccentric axis is in contact with the base of the lock stud actuator piston 41, the lock stud actuator piston 41 is in a locked position and the balls 42 extend beyond the openings to engage retention sinks 473 in the jaw.

Figure 5A:
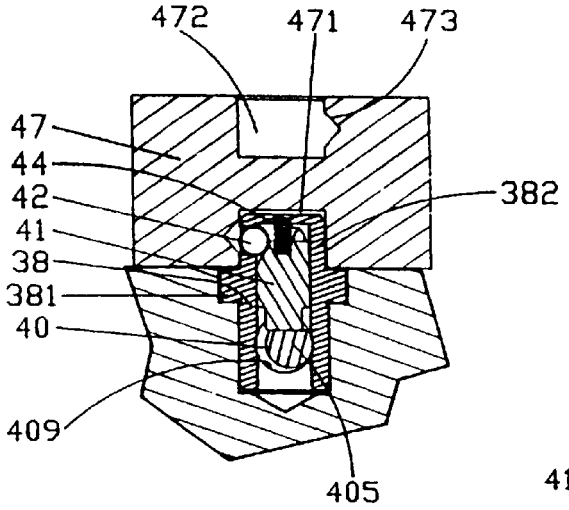
FIGS. 5A and 5B are cross-sections looking along line 5—5 of FIG. 2 and showing the stationary jaw locking mechanism in unlocked and locked positions respectively.
Figure 5B:
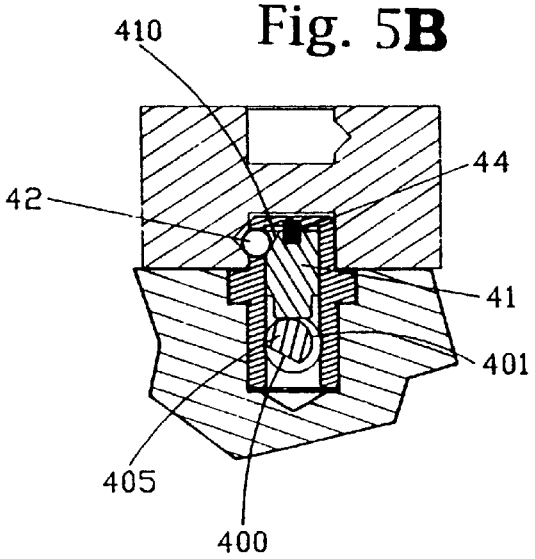

Shown in FIGS. 5A and 5B is one side of stationary jaw 47. As portrayed, the jaw 47 is a soft jaw having a pair of first mounting bores 471 on a first mounting surface and a pair of second mounting bores 472 (only one of each shown in FIGS. 5A and 5B) on the opposite mounting surface so that the jaw 47 may be turned over for use in various machining tasks. Within the inner wall of the mounting bores 471,472 are retention sinks 473 that correspond to the positions of the balls 42 and are for receiving the balls 42 when the lock stud rotation cam shaft 40 is rotated such that cam surface 401 forces the lock stud actuator piston 41 into the upper position causing a portion of the balls 42 to extend beyond the outer surface of the hood 382 of the locking center stud housing 38. Although described as a soft jaw, the stationary jaw 47 might also be a hard jaw. The retention sinks 473 may also be formed as an annular groove extending around the inner surface of the mounting bores 471,472.

One of the two locking center stud housings 38 may have an upwardly extending fool proof pin 39 which mates with a corresponding bore (not shown) in the stationary jaw 47 to assist in fool proof, i.e., consistent, positioning of the stationary jaw 47 with the same orientation. When the fool proof pin 39 is so provided, it replaces one of the mounting screws used to retain the locking center stud housing 38 in the rail 100.

Figure 4:
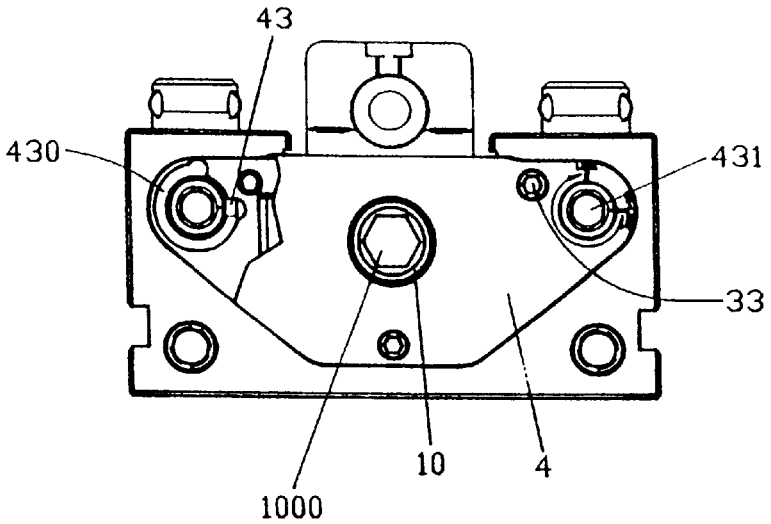
FIG. 4 is a front end view of the vise with a partially cut away front cover plate.

The lock stud rotation cam shaft is rotated by means of a rotation knob 431 (FIG. 4). Any type of connector that permits the operator to rotate the lock stud rotation cam shaft 40 is acceptable. An end of the lock stud rotation cam shaft 40 is itself rotatably mounted in a front cover plate 4. The lock stud rotation cam shaft 40 can be rotated approximately 270° between the unlocked and locked positions. A long roll pin 43 is inserted into the lock stud rotation cam shaft 40 and seated in a camming groove 430. The camming groove 430 is formed in the end of the body 1 and enclosed by attaching the front cover plate 4 to the end of the vise body using screws 33. The long roll pin 43 controls rotational movement of the lock stud rotation cam shaft 40 by its movement within camming groove 430 and also controls axial movement of the lock stud rotation cam shaft 40 by being positioned between the body 1 and the front cover plate 4.

A retention screw 45 is provided to prevent rotation of the lock stud actuator piston 41 (FIG. 1). The retention screw 45 is inserted in a bore from the outer side surface of side 106 of the body 1. It extends into a retention groove 450 formed in a portion of the lock stud actuator piston 41 below the camming faces 410.

Figure 8:
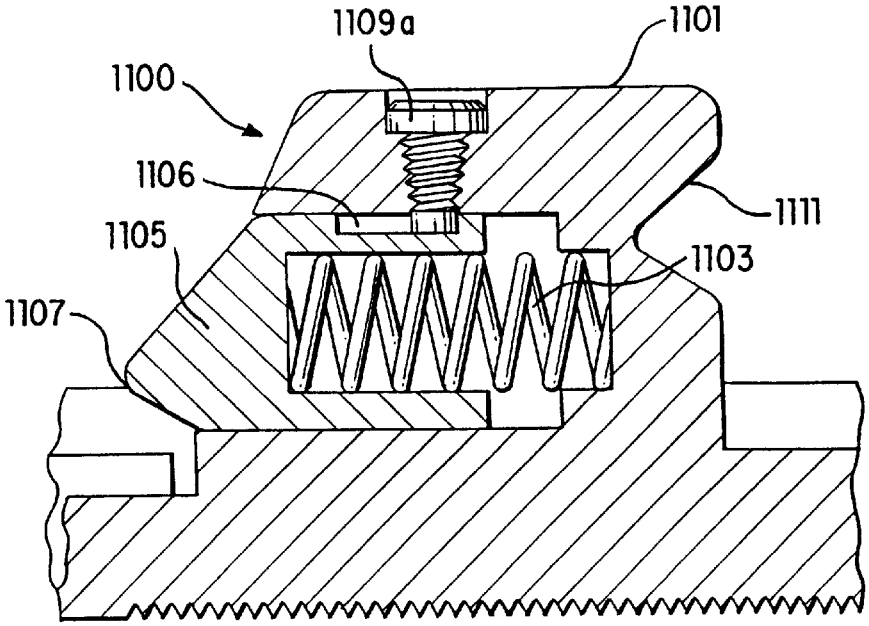
FIG. 8 is an enlarged cross-section view of a first and preferred embodiment of a jaw retainer.

Opposing the stationary jaw 47, at opposite ends of the body 1, are movable front and rear slides 2,3. The slides 2,3 are mounted in the large channel 102 and slide along contact surface 103. Upper shoulders of the slides are in slidable contact with the lower surface of rails 100. Extending upwardly from the slides 2,3, through the channel 101, is a jaw block retainer 1100. Either soft jaws or hard jaws may be attached to the jaw block retainer 1100. A preferred embodiment of the jaw block retainer 1100 is shown in FIG. 8.

In this embodiment, a latch 1105 is retained in a body 1101, of the jaw block retainer 1100, by means of a retainer screw 1109*a*. The retainer screw 1109*a* is received in a threaded bore extending downwardly from an upper surface of the body 1101. A tip of the retainer screw 1109*a* is received in a groove 1106 formed in an upper surface of the latch 1105. The groove 1106 has sufficient width to enable the latch 1105 to retract against the tension of a spring 1103. This embodiment is preferred for ease in assembly and because the tension applied by the spring 1103 will not cause the retainer screw 1109*a* to back out or become loose over time. The forward end (with respect to clamping direction of movement) of the body 1101 has an extension 1110 with a sloped under surface 1111. The under surface 1111 is part of a substantially V-shaped recess in the body 101 for a accommodating rod 646 (see FIG. 9) which is part of the mounted jaw 640.

Figure 9:
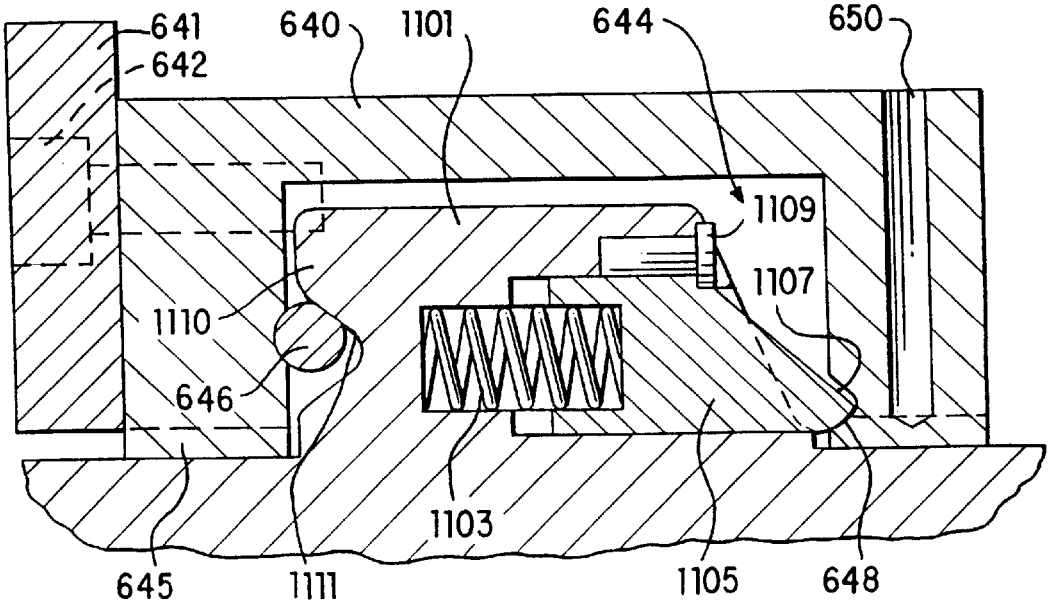
FIG. 9 is a cross-section view of a second embodiment of a jaw retainer.

FIG. 9 shows an alternative embodiment of the jaw block retainer 1100. In this embodiment, the release mechanism comprises the latch 1105 and the spring 1103 mounted in the bore in the body 1101. The latch 1105 is retained in the body 1101 by means of a retainer screw 1109.

For a detailed description of the attachment mechanisms and the jaws see U.S. patent applications Ser. Nos. 08/113,048 and 08/229,806, the disclosures of which have been incorporated herein by reference thereto.

As can be seen in FIG. 6, each rail 100 has a groove 107 formed in the inner surface toward the channel 101. A bottom chip shield 7 is inserted into the opposing grooves 107 and extends the entire length of the channel 101. Openings are provided in the bottom chip shield 7 to permit the jaw block retainers 1100 to extend therethrough. The openings have a length, along the longitudinal axis of the body 1, sufficient to accommodate the jaw block retainers 1100 and their stroke. As shown in FIG. 2, with the front and rear slides 2,3 withdrawn from the stationary, center jaw 47, the gap 70, equivalent to the stroke, is seen forward of the jaw block retainers 1100.

In addition, a top chip shield 6 is mounted over each jaw block retainer 1100 and fitted into the grooves 107. The top chip shield 6 moves with the respective slide 2,3 and has a lead edge, that is, toward the stationary, center jaw 47, that extends beyond the gap 70 when the slides 2,3 are in their most rearward positions so that the channel 101 is closed, or sealed, by the combination of top chip shields 6 and bottom chip shield 7.

To ensure an effective seal, chip shield stop bumpers 21 may be provided in a top surface of the slides 2,3. The chip shield stop bumpers 21 are compressible rubber bumpers received in bores in the upper surface of the slides 2,3. The chip shield stop bumpers 21 push on the underside of bottom chip shield 7 forcing it upwardly into tighter contact with the top chip shields 6. The top and bottom chip shields 6,7 may be made of a thin metal or alternatively of a semi-rigid plastic, resin, or rubberized material.

As shown in FIGS. 4 and 6, the ends of vise body 1 are closed by the front cover plate 4 and a rear cover plate 5, respectively. In combination with top chip shields 6 and bottom chip shield 7, the large channel 102 is totally enclosed.

Sealably and rotatably mounted in the front cover plate 4 is a spline drive screw extension 19. The spline drive screw extension 19 is received in a bore 190 in one end of the vise screw 10. The bore 190 has splines 191 for engaging the grooves of the spline drive screw extension 19. In the end of spline drive screw extension 19 that is rotatably mounted in the front cover plate 4, and retained therein by a spline drive retainer plate 18, is a turn receptacle 1000 for receiving a crank (not shown) end. Alternatively, a male extension could be provided for inserting into a female end of a crank mechanism.

The end of the vise screw 10 engaged with the spline drive screw extension 19 is rotatably mounted within the front slide 2. The vise screw 10 extends through a bore in the front slide 2 and at its opposite end is threadably received in a threaded bore of the rear slide 3. A seal 28 is provided in the rear slide 3 where the vise screw 10 enters the threaded bore to protect the threaded engagement therein.

Mounted, by means of screws 33, to the base 104 of the body 1 immediately below the vise screw 10, and having a mid-point at the intersection of the longitudinal axis of the vise 1 and the center line between the locking center stud housings 38, is a center auto stop 17. The front and rear slides 2,3 have a maximum stroke defined by the ends of the center auto stop 17. When the slides 2,3 abut the ends of the center auto stop 17 no further movement is possible.

To provide for the non-simultaneous retention and release of workpieces, the vise includes a brake assembly and an offset assembly. The two assemblies will be discussed with reference to FIGS. 1–3, 6 and 7A–7F.

The brake assembly has a brake setting rod 16 housed in a bore 169 extending through the rear slide 3 and the jaw block retainer 1100. A rod head 160 is partially recessed in the bottom surface of rear slide 3. The bottom surface of the rear slide 3, at the portion where the rod head 160 is located, is defined by a channel 300 that has been cut in the undersurface for receiving and mounting a brake spring 13. The brake spring 13 is pivotally mounted by means of a dowel 34. The brake spring 13 is transverse to the longitudinal axis of the body 1 and the dowel pin 34 extends parallel to the longitudinal axis of the body 1 through the side wall of the channel 300 and into a bore 341 in the bottom portion of the rear slide 3. The dowel pin 34 is retained in the bore 341 by means of a set screw 46 inserted from the bottom of rear slide 3.

On the bottom surface of the rod head 160 is a ridge 161 extending along a diameter. As best shown in FIGS. 7A–7F, the ridge is received in one of three pressure grooves 131 formed in an upper surface of the pressure end 130 of the brake spring 13. A first groove, which is parallel to the longitudinal axis of the brake spring 13, defines a load or neutral position so that no pressure is applied to the brake. A second pressure groove 131, offset to one side by 60° from the first groove 131, has a lesser depth therefore applying a first pressure to pressure end 130 of the brake spring 13 which is translated through the pivot dowel 34 to an upward pressure on brake end 132 (FIG. 6). A third pressure groove 131, offset in the opposite direction by 60° from the first groove 131, is of even shallower depth therefore providing greater downward pressure on pressure end 130 and subsequent upward pressure on brake end 132. Thus, by rotating brake setting rod 160, using turn receptacle 162, the brake pressure may be adjusted from no pressure through a light pressure to a heavy pressure and brake action.

Received in a recess 301 in the rear slide 3 are a fixed brake pad 11, seated in an upper portion of the recess 301 and a movable lower brake pad 110. A bottom surface of the lower brake pad 110 rests on an upper surface of the brake end 132 of the spring brake 13. The upward pressure of brake end 132 causes the movable brake pad 110 to move toward the fixed brake pad 11 clamping an offset brake rod 12 therebetween.

A brake lever stop bar 8 has a pivot end 801, with front and rear camming surfaces, (directions defined in terms of the slide movement during clamping) received in a pivot groove 802 in body 1. A contact end 803 is maintained in contact with a contact surface 141 of an offset dial stop 14. The offset brake rod 8 is pivotally mounted to a pivot dowel 808 seated in a bore extending from the top to the bottom of brake lever stop bar 8. A centering mechanism 15 may be provided in the brake lever stop bar 8 to center the offset brake rod 12 so that it is substantially transverse to the brake lever stop bar 8 for ease in assembly and maintenance.

The offset brake rod 12 extends into a bore 120 in the rear slide 3 (FIG. 1). The bore 120 is parallel to the longitudinal axis of the body 1. As seen in FIG. 6, the brake pads 11,110 have arc shaped segments removed which are aligned with the bore 120 and which engage the outer circumference of offset brake rod 12. By placing the brake setting rod 16 in either of the light or heavy pressure positions, either a light or heavy pressure is applied to the movable brake pad 110 thereby clamping the offset brake rod 12 between the fixed brake pad 11 and the movable brake pad 110 with either a light or heavy braking pressure, respectively.

The offset mechanism will be described with reference to FIGS. 1, 3 and 6. The offset mechanism is mounted within the rail 100 adjacent to the contact end 803 of brake lever stop bar 8. An offset dial stop 14 is seated in a bore in the side 106 and has an axis parallel to the longitudinal axis of the body 1. As noted earlier, the contact surface 141 is in contact with a surface of the contact end 803 of brake lever stop bar 8. An opposite end of the offset dial stop 14 is engaged with a compression spring 31 which extends through the bore to a contact spring cap 372. A smaller, lighter weight compression spring 32 is also retained between the offset dial stop 14 and the spring cap 372 and within the coils of the compression spring 31. On an upper surface of the offset dial stop 14 is a groove 142 having a rear face 143.

Seated in a bore extending from the top of the rail 100 to intersect the bore containing the offset dial stop 14 is an offset dial 9. The offset dial 9 is slightly recessed below the surface of rail 100. In the upper surface of the offset dial 9 is a turn receptacle 90 for rotating the offset dial to establish an offset position. The offset dial has an essentially cylindrical upper portion and an offset extension 91 extending downwardly therefrom. The offset extension 91 has a substantially triangular cross-section, (as seen in FIG. 1) although the apexes are truncated as necessary to fit within the bore. The flat surfaces of the offset extension 91 comprise the offset faces and are positioned at different distances from the axis of rotation of the offset dial 9 to establish the offset distance. As shown in FIG. 1, offset dial 9 is rotated such that the contact face facing rear face 143 of offset dial stop 14 is the offset of the minimum or smallest distance of 1/32 of an inch. The other offsets, as provided in this embodiment, are 3/16 of an inch and 3/8 of an inch although other offsets can be used by adjusting the shape of the offset extension 91.

A detente groove 92 is provided around the circumference of the cylindrical upper portion of the offset dial 9. A detente ball assembly (not shown) is inserted through a bore from the outside of side 106 so that the ball is received in detente groove 92 to retain the offset dial in the vise body. Detente recesses 93 are provided in the detente groove 92 for further receiving the detente ball and identifying the offset positions, i.e., when a contact face of the offset extension 91 is parallel to the rear face 143 of the offset dial stop 14.

Also seated in a bore extending from the top surface of the rail 100, transverse to and intersecting the bore containing offset dial stop 14, is brake preload dial 37. The brake preload dial 37 is also slightly recessed below the surface of the rail 100 and has a generally cylindrical shape. However, at a point corresponding to the bore containing the offset dial stop 14 and the compression springs 31,32 is a preload segment 371. The preload segment 371, in cross-section, has a substantially triangular shape with truncated apexes so as to be received in the bore. The resultant faces are at different distances from the axis of rotation of the brake preload dial 37.

By rotating the brake preload dial 37, using turn receptacle 370, one of the faces can be brought into contact with the front face of the spring cap 372. When the face having the shortest distance to the axis of rotation of the brake preload dial 37 is in contact with the front face of the spring cap 372, the lightest pressure is applied to compression spring 31 and compression spring 32 has no compression pressure applied thereto. The pressure from the compression spring 31 is applied through the offset dial stop 14 to maintain the contact surface 141 of the offset dial stop 14 in contact with the contact end 803 of brake lever stop bar 8. Rotating the brake preload dial 37 allows, alternatively, a medium pressure or a heavy pressure to be applied to the contact between the offset dial stop 14 and the contact end 803. In the heavy load position, that is, when the face of the preload segment 371 furthest from the axis of rotation of the brake preload dial 37 is in contact with the front face of the spring cap 372, both compression springs 31,32 are compressed. However, even in this condition, the pressure exerted by the compression springs 31,32 does not overcome the braking resistance provided by the fixed and movable brake pads 11,1110 as applied to the offset brake rod 12.

Above the preload segment 371, in the brake preload dial 37, is a retention groove 373. A set screw (not shown), inserted in a bore through the side 106 engages retention groove 373 to retain the brake preload dial 37 in the body 1.

In operation, the operator can set the brake pressure and the offset and the brake preload prior to mounting a jaw to the jaw block retainer 1100 of the rear slide 3. If the operator sets the brake pressure, using the brake setting rod 16, to the normal load position, then no brake pressure is applied and the vise operates as a normal two station vise with both the front and rear slides 2,3 moving simultaneously upon rotation of the vise screw 10.

However, if the operator sets the brake setting rod 16 to either the light load position or the heavy load position, then the braking mechanism and the offset mechanism, associated with the rear slide 3, operate to preclude movement of the rear slide 3 until the front slide 2 has completed movement by engaging either a workpiece or encountering the auto center stop 17. The vise screw 10 is rotated by inserting a crank handle (not shown) into the turn receptacle 190 of the spline drive screw extension 19. When a brake load has been applied, upon rotation of the vise screw 10 to close the slides 2,3 toward the stationary, center jaw 47, the front slide 2 moves first. The brake mechanism restrains the rear slide 3 from moving until movement of the front slide 2 engages a workpiece between the jaw 640 mounted to the front slide 2 and the stationary, center jaw 47 or the base of the front slide 2 encounters the center auto stop 17.

At that time, the continued rotation of the vise screw 10, in the threaded bore 390 of the rear slide 3, will cause the rear slide 3 to move toward the stationary, center jaw 47 until the rear face 143 of the offset dial stop 14 contacts the positioned offset face of offset extension 91. When contact is made, the rear slide will then continue to move against the resistance of the brake mechanism applied by the brake pads 11,110 to the offset brake rod 12. During the initial offset movement, the brake lever stop bar 8 will pivot at the pivot end 801 in the pivot groove 802. The rear slide 3 will continue to move toward the stationary, center jaw 47 until a workpiece is engaged between the stationary, center jaw 47 and the jaw 640 mounted to the rear slide 3 or the front portion of rear slide 3 engages the center auto stop 17.

When the vise screw is counter-rotated to open the movable jaws, rear slide 3 will initially retract the offset distance due to pressure applied by the compression springs 31,32. At that time, because the offset brake rod 12 is engaged by the brake pads 11,110, movement of rear slide 3 will cease and the front slide 2 will retract until it abuts front cover plate 4. With further counter-rotation of the vise screw 10, the rear slide 3 will commence movement against the resistance of the brake mechanism to retract from the stationary, center jaw 47.

Having described a manually operated, totally-enclosed, two station machining vise and its operation, a second embodiment which includes hydraulic operation will now be described. The reference numbers of parts corresponding to the manual vise remain the same and a description of those elements will be omitted.

Figure 10:
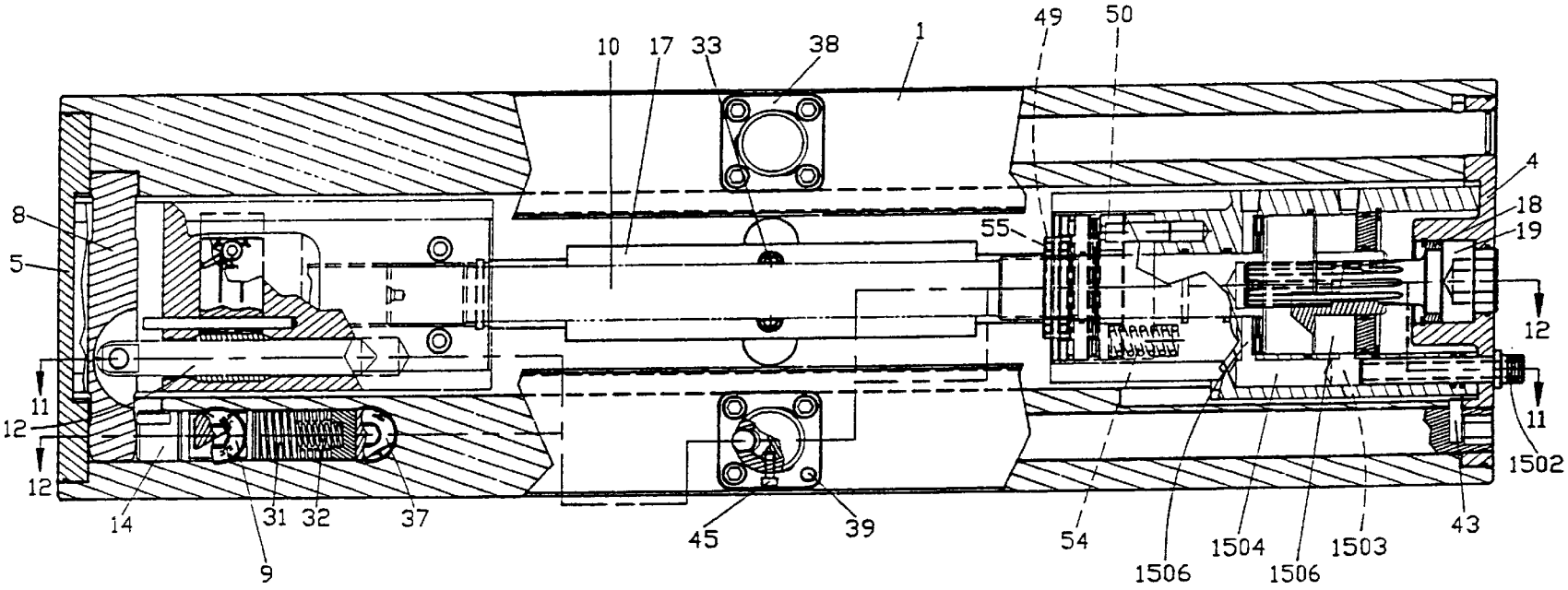
FIG. 10 is a top plan, partially cut away, and partial cross-section view of the vise of a second embodiment.

The hydraulic components of the vise will be discussed with reference to FIGS. 10–12.

The second embodiment of the vise allows for repetitive replacement of workpieces using a consistent clamping pressure. It relieves the strain on the operator for repetitively clamping and releasing the movable slides 2,3 when replacing workpieces.

The end of the vise screw 10 is rotatably mounted in the front slide 2. The front slide 10 contains a bore 190 having internal splines 191 to engage the spline drive screw extension 19 as found in the first embodiment.

Hydraulic fluid is provided through and removed from a hydraulic chamber 1506 within front slide 2. An unclamp nipple 1501 allows the feed of hydraulic fluid to a passage 1503 and through an opening into a rear (in the direction of clamping movement of the slide), or unclamp, side of piston 1500, of the hydraulic chamber 1506. The piston 1500 is an enlarged flange extending from vise screw 10. A clamp nipple 1502 allows the introduction of the hydraulic fluid through passage 1504 and an opening to hydraulic chamber 1506 at the rear, or clamp, side of the piston 1500. A thrust bearing/washer combination 56, providing the contact surface between the piston 1500 and the front slide 2, can float freely when the hydraulic fluid has been injected into the hydraulic chamber 1506 at the rear, or clamp, side of the piston 1500. Obviously, when the hydraulic fluid is being fed through the unclamp nipple 1501, the clamp nipple 1502 allows hydraulic fluid to escape from the opposite side of the piston 1500 and vice versa.

Figure 11:
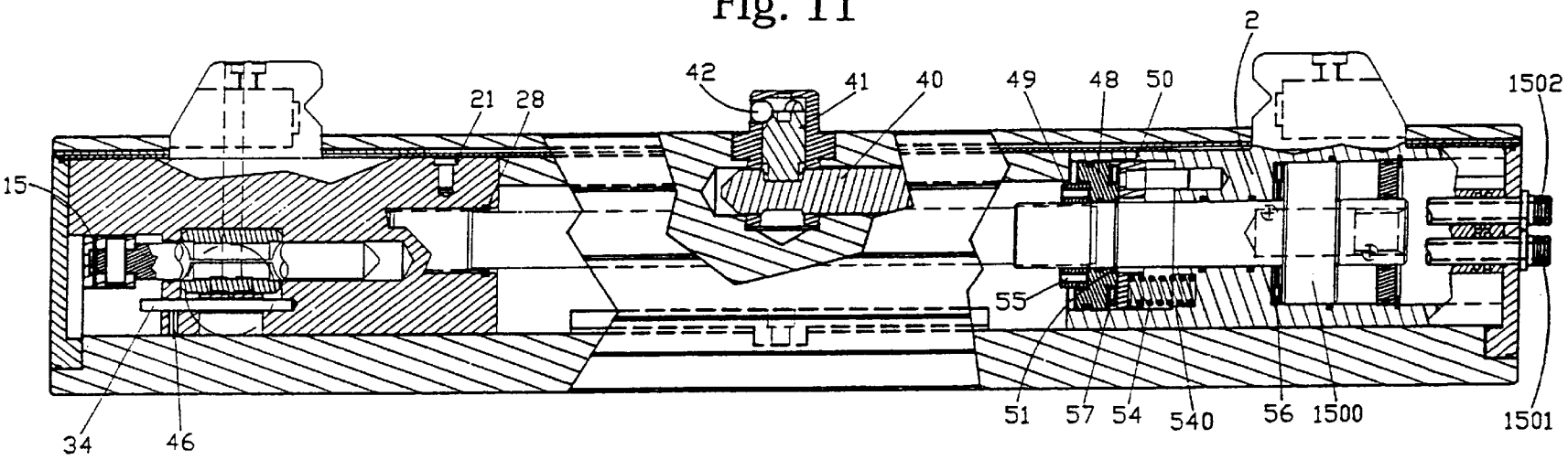
FIG. 11 is a side, partially cut away, partial cross-section view of the vise of the second embodiment substantially along line 11—11 in FIG. 10.
Figure 12:
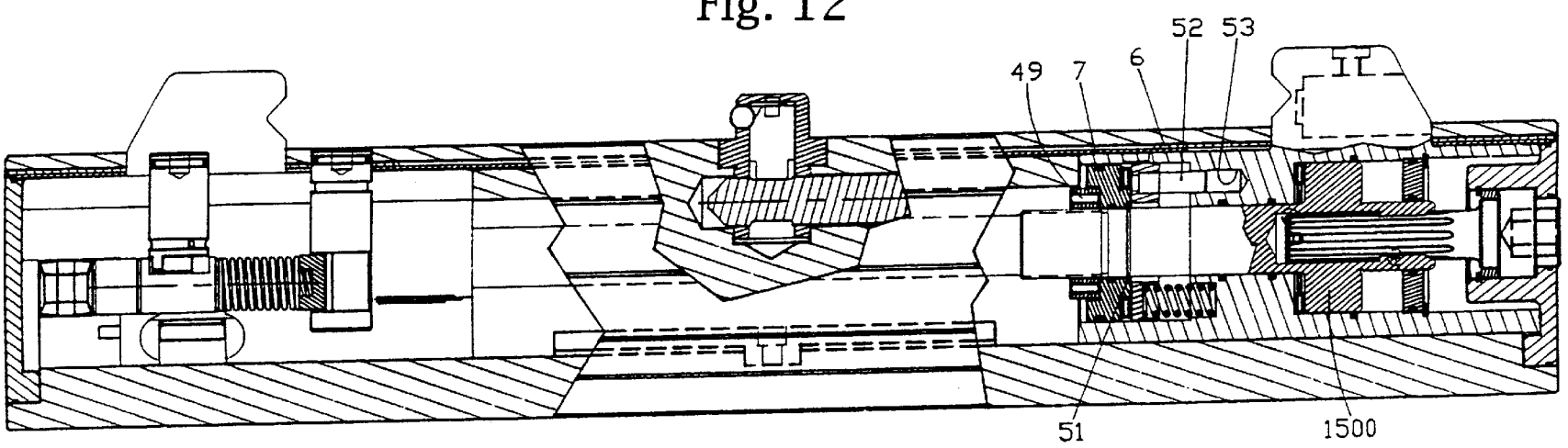
FIG. 12 is a side, partially cut away, partial cross-section view of the vise of the second embodiment substantially along line 12—12 of FIG. 10.

Threadably mounted to the outside of the vise screw 10, at a front end of front slide 2 is a rear seal flange 49 (FIG. 11). The rear seal flange 49 is received in a recess in a thrust bearing retainer plate 48. The thrust bearing retainer plate 48 contacts a retainer plate clip 51. When the rear flange seal 49 is tightened down, and set screws 55 are threaded through the rear seal flange 49 to engage the thrust bearing retainer plate 48, the combination is effectively fixed to the vise screw 10 so that it rotates with the vise screw 10. A thrust bearing/washer combination 57 is seated in an annular groove in the thrust bearing retainer 48 on a side toward the front cover plate 4. The thrust bearing/washer combination 57 contacts a spring retainer plate 50. The vise screw 10 passes through an opening in the spring retainer plate 50 and the spring retainer plate 50 is fixed to the front slide 2 by means of retainer pin 52 which is engaged in retainer pin bore 53 bored into the front slide mount 2 parallel to the longitudinal axis of the body 1. A compression spring 54, housed at one end in a spring seat 540 bored into the front slide 2, is seated, at its other end, in a recess in the spring retainer plate 50. The assembly, comprised of the thrust bearing retainer plate 48, the rear seal flange 49, the set screws 55, the thrust bearing/washer combination 57, the spring retainer plate 50 and the piston retention spring 54 cause the vise screw 10 to be axially urged toward the rear slide 3 so that the piston 1500 is normally in contact with the end of the hydraulic chamber 1506, through the thrust bearing/washer combination 56, of the front slide 2 that is closest to the stationary, center jaw 47. This assembly also allows hydraulic arrangement to be used as single acting.

In operation, the second embodiment of the vise is closed upon the workpieces in the same manner as is the manual vise of the first embodiment. Once the workpieces have been engaged, the vise screw 10 is counter-rotated to disengage the jaw 640 mounted on the rear slide 3 from the workpiece a distance equal to the offset distance. The vise screw 10 then is counter-rotated enough to withdraw the jaw 640 mounted to the front slide 2 an equal distance from the workpiece held between the front slide 2 and the stationary, center jaw 47. At that time, hydraulic fluid is introduced through clamp nipple 1502 and fed to the front, or clamping, face of the piston 1500. Such an action causes the two slides to be drawn together to reclamp the workpieces. By reversing the flow of the hydraulic fluid, such that it is introduced through unclamp nipple 1501 into the hydraulic chamber 1506 at the unclamp, or rear, face of piston 1500, the two slides 2,3 are forced apart the amount of offset previously established. The result is that a consistent clamping pressure can be obtained and workpieces may be rapidly exchanged without manual effort by an operator.

What is claimed is:

1. A two station vise assembly comprising a body having guide means for guiding movable vise jaws, a stationary jaw removably mounted on a middle portion of said body, a first movable slide and a second movable slide mounted on said guide means for linear movement on opposite sides of said stationary jaw, a movable jaw removably mounted on each of said movable slides, means for moving said first and second slides, a brake mechanism mounted for braking the movement of one of said movable slides, an off-set mechanism mounted on said body for stopping the movement of one of said movable slides, and a hydraulic actuator connected to move said first and second movable slides toward and away from said stationary jaw by a small off-set distance as determined by said off-set mechanism.

2. A vise assembly as defined in claim 1 and including a cam actuated locking mechanism for releasably locking said stationary jaw to said body.

3. A vise assembly as defined in claim 1 wherein said means for moving said slides comprise a rotatable screw connecting said slides and having an axis, and said off-set mechanism is spaced laterally within said body from said axis of said screw.

4. A two station vise assembly comprising a body having guide means for guiding movable vise jaws, a stationary jaw removably mounted on a middle portion of said body, a first movable slide and a second movable slide mounted on said guide means for linear movement on opposite sides of said stationary jaw, a movable jaw removably mounted on each of said movable slides, an elongated screw having an axis and connecting said first and second slides for moving said first and second slides, a brake mechanism mounted for braking the movement of one of said movable slides, an off-set mechanism mounted on said body for stopping the movement of one of said movable slides, and a hydraulic actuator connected to said screw for moving said screw axially to move said first and second movable slides toward and away from said stationary jaw by a small off-set distance as determined by said off-set mechanism.

5. A vise assembly as defined in claim 4 wherein said off-set mechanism is spaced laterally within said body from said axis of said screw.

6. A vise assembly comprising a body having means for guiding movable vise jaws therein, a stationary jaw removably mounted at a mid-point on said body, a first movable slide and a second movable slide mounted in said means for guiding movable vise jaws, a jaw removably mounted to each said slide, means for moving said first and second movable slides, a brake assembly pivotally mounted in a side wall of the means for guiding movable vise jaws and being engaged by a braking mechanism mounted in said first movable slide, an offset assembly mounted in said body and engaging said brake assembly on a side of said body away from said side wall, and means for enclosing the means for guiding movable vise jaws.

7. The vise assembly as claimed in claim 6 wherein said body has two rails, a mounting mechanism for retaining the stationary jaw comprising a housing mounted in each rail with an upwardly extending mounting hood, an actuator piston received in said housing, an elastic member between said actuator piston and a top of said mounting hood, at least one camming surface on said actuator piston at an end adjacent said elastic member, at least one opening in said mounting hood and corresponding to said at least one camming surface, a locking member received on said at least one camming surface for extending partially from said opening, and means for axially moving said actuator piston in said housing.

* * * * *